US006327872B1

(12) United States Patent
Boyd et al.

(10) Patent No.: US 6,327,872 B1
(45) Date of Patent: Dec. 11, 2001

(54) METHOD AND APPARATUS FOR PRODUCING A PRESSURIZED HIGH PURITY LIQUID CARBON DIOXIDE STREAM

(75) Inventors: Robert Walter Boyd, Orinda, CA (US); Jessi Lynn Pike, Vancouver, WA (US); David C. Cheng, Fremont, CA (US); Kelly Leitch, Napa, ID (US)

(73) Assignee: The BOC Group, Inc., Murray Hill, NJ (US)

( * ) Notice: Subject to any disclaimer, the term of this patent is extended or adjusted under 35 U.S.C. 154(b) by 0 days.

(21) Appl. No.: 09/604,947

(22) Filed: Jun. 27, 2000

Related U.S. Application Data

(60) Provisional application No. 60/174,531, filed on Jan. 5, 2000.

(51) Int. Cl.[7] ..... F25J 1/00

(52) U.S. Cl. ..... 62/636; 62/908; 62/928

(58) Field of Search ..... 62/908, 636, 928

(56) References Cited

U.S. PATENT DOCUMENTS 3,420,633 * 1/1969 Lee ..... 62/928
4,337,071 * 6/1982 Yang ..... 62/908
4,717,406 * 1/1988 Giacobbe ..... 62/908
4,806,171 2/1989 Whitlock et al. .
5,028,273 7/1991 Weltmer, Jr. et al. .
5,582,029 * 12/1996 Occhialini et al. ..... 62/636
6,164,088 * 12/2000 Moriguchi et al. ..... 62/636

* cited by examiner

*Primary Examiner*—Ronald Capossela
(74) *Attorney, Agent, or Firm*—Joshua L. Cohen; Salvatore P. Pace

(57) ABSTRACT

The present invention provides a method and apparatus for producing a pressurized high purity liquid carbon dioxide stream in which a feed stream composed of carbon dioxide vapor is purified within a purifying filter and then condensed within a condenser. The result liquid is then alternately introduced and dispensed from two first and second pressure accumulation chambers. The first and second pressure accumulation chambers are heated by electrical heaters to pressurize the liquid to the required or desired delivery pressure of the pressurized liquid carbon dioxide stream. Such stream is alternately extracted from the first and second pressure accumulation chambers on a continuous basis in which one of the first and second pressure accumulation chambers acts in a dispensing role while the other is being filled. The pressurized liquid carbon dioxide stream can be further filtered within a particulate filter.

8 Claims, 1 Drawing Sheet

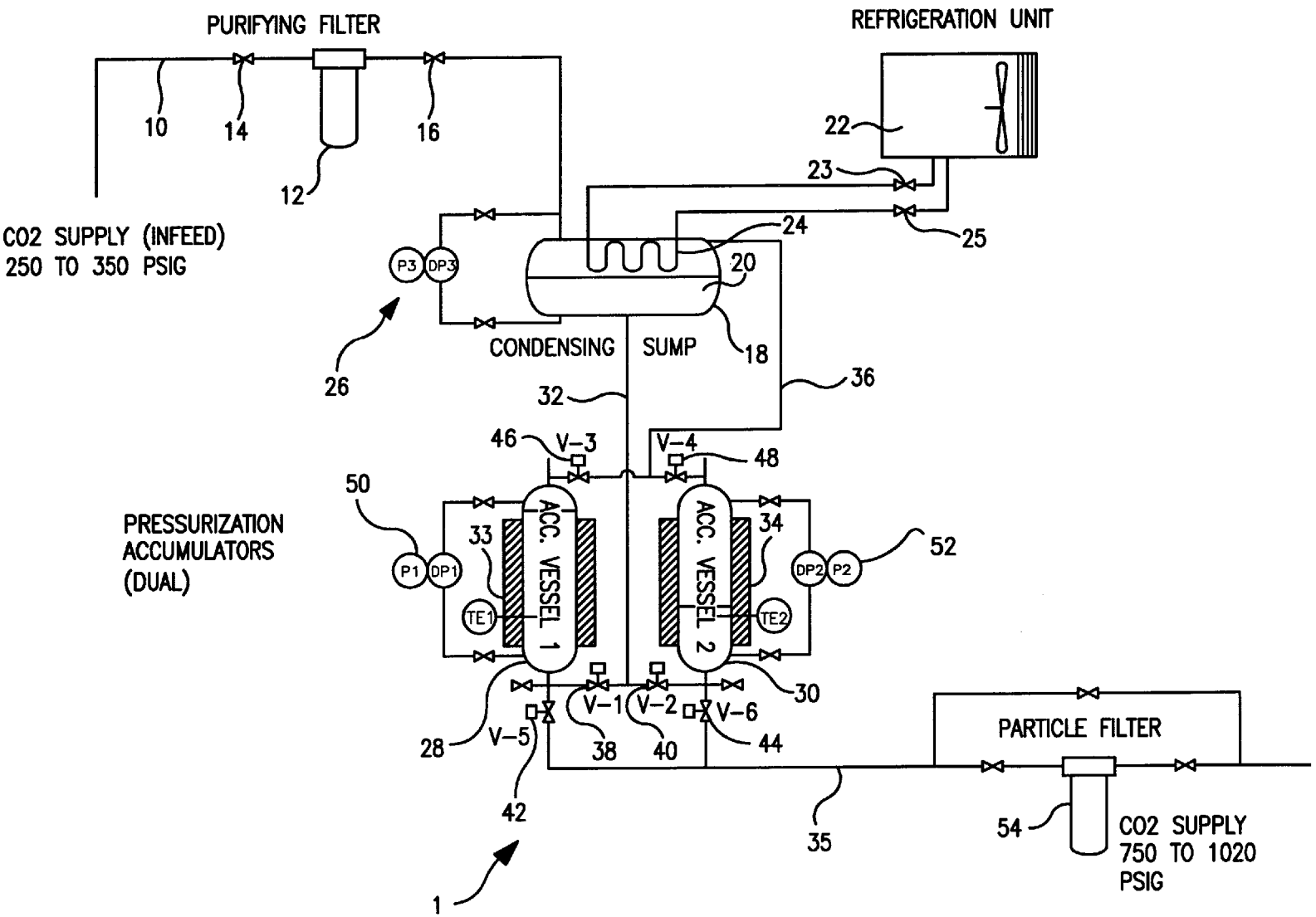
REFRIGERATION UNIT
22
23
25
24
20
18
36
SUMP
CONDENSING
32
V-4
48
V-3
46
ACC. VESSEL 2
ACC. VESSEL 1
34
33
TE2
TE1
DP2
P2
DP1
P1
52
50
30
44
V-6
V-2
40
V-1
38
V-5
42
28
1
PARTICLE FILTER
54
CO2 SUPPLY
750 TO 1020
PSIG
35
DP3
P3
26
16
PURIFYING FILTER
12
14
10
CO2 SUPPLY (INFEED)
250 TO 350 PSIG
PRESSURIZATION
ACCUMULATORS
(DUAL)

METHOD AND APPARATUS FOR PRODUCING A PRESSURIZED HIGH PURITY LIQUID CARBON DIOXIDE STREAM

RELATED APPLICATIONS

This application claims priority from Provisional Patent Application No. 60/174,531 filed Jan. 5, 2000, which is hereby incorporated herein by reference.

BACKGROUND OF THE INVENTION

The present invention relates to a method and apparatus for producing a purified and pressurized liquid carbon dioxide stream in which a feed stream composed of carbon dioxide vapor is condensed into a liquid that is subsequently pressurized by being heated within a chamber. More particularly, the present invention relates to such a method and apparatus in which two chambers are used so that the pressurized liquid carbon dioxide stream can be continually dispensed.

Highly pressurized, purified liquid carbon dioxide is required for a variety of industrial processes. Such highly pressurized liquid is produced by purifying industrial grade liquid carbon dioxide that is available at about 13 to 23 bar and then pumping the liquid to a pressure of anywhere from between about 20 and about 68 bar.

The problem with pumping, however, is that impurities such as particulates or hydrocarbons can be introduced into the product stream as a byproduct of mechanical pump operation. As will be discussed, this problem is overcome in the present invention.

SUMMARY OF THE INVENTION

The present invention provides a method of producing a pressurized liquid carbon dioxide stream in which a feed stream composed of carbon dioxide vapor is introduced into a purifying filter. The purified feed stream is condensed within a condenser having a sump and an intermediate liquid stream is introduced from the condenser sump into first and second pressure accumulation chambers. The first and second pressure accumulation chamber are heated to pressurize liquid contained therein and the pressurized liquid carbon dioxide stream is delivered from the first and second pressure accumulation chambers.

The intermediate liquid stream is alternately introduced into the first and second pressure accumulation chambers and the pressurized liquid carbon dioxide stream is alternately delivered from the first and second pressure accumulation chambers such that prior to one of the first and second pressure accumulation chambers becoming empty, the intermediate liquid stream is introduced into the other of the first and second pressure accumulation chambers. This ensures continual delivery of the pressurized liquid carbon dioxide stream. Each of the first and second pressure accumulation chambers is vented to the sump of the condenser prior to introduction of the intermediate liquid stream therein.

Preferably, each of the first and second pressure accumulation chambers is electrically heated. Additionally, the feed stream is preferably condensed within the condenser through indirect heat exchange with a refrigerant stream. The pressurized liquid carbon dioxide stream can be further treated through its introduction into a particle filter.

In another aspect, the present invention provides an apparatus for producing a pressurized liquid carbon dioxide stream. In such aspect, a purifying filter is provided for purifying a feed stream composed of carbon dioxide vapor and a condenser having a sump is used for condensing the feed stream. First and second pressure accumulation chambers are associated with heaters for heating the first and second pressure accumulation chambers, thereby to pressurize liquid contained therein.

A flow network, associated with the pressure accumulation chambers, has conduits connecting the sump of the condenser to the first and second pressure accumulation chambers for discharging the pressurized liquid carbon dioxide stream therefrom. The flow network has valves associated with the conduits to allow for an intermediate liquid stream to be alternately introduced from the sump of the condenser into the first and second pressure accumulation chambers and the pressurized liquid carbon dioxide stream to be alternately delivered from the first and second pressure accumulation chambers such that prior to one of the first and second pressure accumulation chambers becoming empty, the intermediate liquid stream is introduced into the other of the first and second pressure accumulation chambers. This acts to ensure continual delivery of the pressurized liquid carbon dioxide. The conduits additionally include a vent line from the first and second pressure accumulation chambers to the condenser to allow each of the first and second pressure accumulation chambers to be vented prior to introduction of the intermediate liquid stream therein.

Preferably, the heaters comprise electrical heaters and the condenser includes an external refrigeration circuit having a heat exchanger to condense the feed stream through indirect heat exchange with a refrigerant stream. The apparatus can further comprise a particle filter connected to the flow network to filter the pressurized liquid carbon dioxide stream.

As may be appreciated from the above discussion, since heaters are used to pressurize the liquid, the liquid never contacts a mechanical pump component that could introduce impurities into the pressurized liquid carbon dioxide. Furthermore, since a pump is not used, maintenance requirements for an apparatus in accordance with the present invention are reduced over prior art devices.

BRIEF DESCRIPTION OF THE DRAWINGS

While the specification concludes with claims distinctly pointing out the subject matter that applicants regard as their invention, it is believed that the invention will be better understood when taken in connection with the sole FIGURE which is a schematic view of an apparatus for carrying out a method in accordance with the present invention.

DETAILED DESCRIPTION

With reference to the FIGURE, an apparatus 1 in accordance with the present invention is illustrated. A feed stream 10 composed of carbon dioxide vapor is introduced into a purifying filter 12 which can be any of a number of known, available coalescing and/or selective adsorbent filters. Valves 14 and 16 are provided to isolate purifying filter(s) 12.

The feed stream after having been purified is introduced into a condenser 18 which is provided with a sump to condense the vapor into a liquid 20. Such condensation is effectuated by an external refrigeration unit 22 that circulates a refrigeration stream through a heat exchanger 24, preferably of shell and tube design. In this regard, the condenser 18 can consist of a heat exchanger feeding a separate sump. Isolation valves 26 and 28 can be provided to isolate refrigeration unit 22. The level of liquid is controlled by a differential pressure transducer 26 that senses the pressure differential between the liquid and vapor within condenser 18. Although not illustrated, a controller in the form of a programmable logic computer receives signals from differential pressure transducer 26 to activate refrigeration unit 22 when the liquid 20 drops below a predetermined level.

As may be appreciated, since vapor is being condensed within condenser 18, a separation of any impurities present within the vapor might be effectuated by which the more volatile impurities would remain in uncondensed vapor and less volatile impurities would be condensed into the liquid. Although not illustrated, sample lines might be connected to condenser 18 for sampling and drawing off liquid and vapor as necessary to lower impurity concentration within condenser 18.

An intermediate liquid stream composed of high purity liquid 20 is introduced into first and second pressure accumulation chambers 28 and 30. First and second pressure accumulation chambers 28 and 30 are preferably heated by way of electrical heaters 33 and 34, respectively, to pressurize the liquid to a delivery pressure of the pressurized liquid carbon dioxide stream to be produced by apparatus 1.

Liquid flow to and from first and second pressure accumulation chambers 28 and 30 by way of a flow network having an inlet conduit 32 to supply the intermediate liquid stream to pressure accumulation chambers 28 and 30. The pressurized liquid carbon dioxide stream is delivered from first and second pressure accumulation chambers 28 and 30 through an outlet conduit 35. Further, each of the first and second pressure accumulation chambers 28 and 30 is vented through a vent line 36 to condenser 18.

A valve network controls the flow within the flow network. In this regard, control valves 38 and 40 control the flow of the intermediate liquid stream from condenser 18 to first and second pressure accumulation chambers 28 and 30. Control of the flow through outlet conduit 35 is effectuated by control valves 42 and 44. The venting of first and second pressure accumulation chambers 28 and 30 is controlled by control valves 46 and 48.

When second pressure accumulation chamber 30 is near empty, control valve 42 opens and control valve 44 closes to dispense pressurized liquid carbon dioxide from first pressure accumulation chamber 28. At the same time, since second pressure accumulation chamber 30 has been pressurized through electrical heater 34, control valve 48 opens to allow for venting of such pressure to condenser 20. This allows second pressure accumulation chamber 30 to receive more liquid by introduction of the intermediate liquid stream, through inlet conduit 32, into second pressure accumulation chamber 30. To this end, control valve 40 is set in an open position. When differential pressure sensor 50, indicates that second pressure accumulation chamber 30 is full, control valve s 40 and 48 close and the liquid within second pressure accumulation chamber 30 is heated by electrical heater 34 to pressurize the liquid.

When first pressure accumulation chamber 28 is near empty, as sensed by differential pressure sensor 50, control valve 42 closes and control valve 44 opens to allow the pressurized liquid carbon dioxide stream to be dispensed from second pressure accumulation chamber 30. At the same time, control valve 46 opens to vent first pressure accumulation chamber 26 valve. Control valve 38 opens to allow intermediate liquid stream to fill first pressure accumulation chamber 28. When differential pressure sensor indicates the completion of the filling, control valves 38 and 46 close and the liquid is heated by electrical heater 33 to pressurize the liquid within first pressure accumulation chamber 28.

The aforementioned valves function in accordance with a cycle so that the pressurized liquid carbon dioxide is, continually dispensed. This cycle is preferably controlled by a programmable logic controller, not shown, that is connected to differential pressure transducers 50 and 52. Differential pressure transducers 50 and 52 generate signals that are referable to liquid level within first and second pressure accumulation chambers 28 and 30 and in response to such signals, the controller remotely and automatically operates the foregoing control valves. There is also a differential pressure transducer sensing the level of liquid in the condenser 18 and the controller stops the condensation process by turning off refrigeration unit 22 before the condenser vessel is full allowing room for the carbon dioxide to be vented from accumulation chambers 28 and 30 during the filling cycle.

Preferably, outlet conduit 35 is connected to a particle filter 54 to remove any particulate contamination within such liquid.

While the present invention has been described with reference to a preferred embodiment, as will occur to those skilled in the art, numerous additions, changes, and omission can be made without departing from the spirit and scope of the present invention.

We claim:

1. A method of producing a pressurized liquid carbon dioxide stream comprising:

introducing a feed stream composed of carbon dioxide vapor into a purifying filter;

condensing said purified feed stream within a condenser having a sump;

introducing an intermediate liquid stream from said sump into first and second pressure accumulation chambers;

heating said first and second pressure accumulation chambers to pressurize liquid contained therein to a delivery pressure;

delivering said pressurized liquid carbon dioxide stream from said first and second pressure accumulation chambers;

the intermediate liquid stream being alternately introduced into said first and second pressure accumulation chambers and said pressurized liquid carbon dioxide stream being alternately delivered from said first and second pressure accumulation chambers such that prior to one of said first and second pressure accumulation chambers becoming empty, the intermediate liquid stream is introduced into the other of said first and second pressure accumulation chamber to ensure continual delivery of said pressurized liquid carbon dioxide stream; and venting each of said first and second pressure accumulation chambers to said condenser prior to introduction of said intermediate liquid stream therein.

2. The method of claim 1, wherein each of said first and second pressure accumulation chambers is electrically heated.

3. The method of claim 1, wherein said feed stream is condensed within said condenser through indirect heat exchange with a refrigerant stream.

4. The method of claim 1, further comprising introducing said pressurized liquid carbon dioxide stream into a particle filter.

5. An apparatus for producing a pressurized liquid carbon dioxide stream comprising:

a purifying filter for purifying a feed stream composed of carbon dioxide vapor;

a condenser having sump for condensing said feed stream;

first and second pressure accumulation chambers;

heaters for heating said first and second pressure accumulation chambers and thereby pressurizing liquid contained therein to a delivery pressure; and a flow network having conduits connecting said condenser to said first and second pressure accumulation vessels and for discharging said pressurized liquid carbon dioxide stream therefrom;

said flow network having valves associated with said conduits to allow for an intermediate liquid stream to be alternately introduced from said condenser into said first and second pressure accumulation chambers and said pressurized liquid carbon dioxide stream to be alternately delivered from said first and second pressure accumulation chambers such that: prior to one of said first and second pressure accumulation chambers becoming empty, the intermediate liquid stream is introduced into the other of said first and second pressure accumulation chambers, thereby to ensure continual delivery of said pressurized liquid carbon dioxide;

the conduits of said flow network including a vent line from said first and second pressure accumulation chambers to said condenser to allow each of said first and second pressure accumulation chambers to be vented prior to introduction of said intermediate liquid stream therein.

6. The apparatus of claim 5, wherein said heaters comprise electrical heaters.

7. The apparatus of claim 5, wherein said condenser includes an external refrigeration circuit having a heat exchanger to condense said feed stream through indirect heat exchange with a refrigerant stream.

8. The apparatus of claim 5, further comprising a particle filter connected to said flow network to filter said pressurized liquid carbon dioxide stream.

* * * * *